US007224111B2

(12) United States Patent
Kling et al.

(10) Patent No.: US 7,224,111 B2
(45) Date of Patent: May 29, 2007

(54) DIELECTRIC BARRIER DISCHARGE LAMP WITH A BASE

(75) Inventors: Rainer Kling, Wipperfürth (DE); Reinhold Wittkötter, Wipperfürth (DE)

(73) Assignee: Patent-Treuhand-Gesellschaft für Elektrishe Glühlampen mbH, Munich (DE)

( * ) Notice: Subject to any disclaimer, the term of this patent is extended or adjusted under 35 U.S.C. 154(b) by 0 days.

(21) Appl. No.: 10/514,814

(22) PCT Filed: May 14, 2003

(86) PCT No.: PCT/DE03/01554

§ 371 (c)(1),
(2), (4) Date: Nov. 17, 2004

(87) PCT Pub. No.: WO03/098653

PCT Pub. Date: Nov. 27, 2003

(65) Prior Publication Data

US 2005/0218775 A1 Oct. 6, 2005

(30) Foreign Application Priority Data

May 17, 2002 (DE) ..... 102 22 100

(51) Int. Cl.
*H01J 11/00* (2006.01)
*H01J 65/00* (2006.01)

(52) U.S. Cl. ..... 313/234; 313/318.01; 313/318.07; 313/607

(58) Field of Classification Search ..... 313/318.12, 313/234, 607
See application file for complete search history.

(56) References Cited

U.S. PATENT DOCUMENTS

| | | | | |
|---|---|---|---|---|
| 3,684,908 | A * | 8/1972 | Beese | 313/24 |
| 4,310,772 | A * | 1/1982 | Tyler et al. | 313/113 |
| 5,604,410 | A | 2/1997 | Vollkommer et al. | |
| 5,668,433 | A | 9/1997 | Everest et al. | |
| 6,060,828 | A | 5/2000 | Vollkommer et al. | |
| 6,346,767 | B1 * | 2/2002 | Swadel et al. | 313/318.01 |
| 6,561,841 | B2 * | 5/2003 | Norwood et al. | 439/489 |
| 6,686,681 | B1 * | 2/2004 | Allgeier et al. | 313/318.01 |
| 6,847,157 | B2 * | 1/2005 | Kling et al. | 313/234 |
| 2002/0163312 | A1 | 11/2002 | Kling et al. | |

FOREIGN PATENT DOCUMENTS

| | | |
|---|---|---|
| DE | 199 53 533 | 5/2001 |
| DE | 100 48 986 | 11/2002 |
| EP | 0 660 375 | 6/1995 |
| WO | 00/62330 | 10/2000 |

* cited by examiner

*Primary Examiner*—Mariceli Santiago
(74) *Attorney, Agent, or Firm*—Carlo S. Bessone

(57) ABSTRACT

An elongated dielectric barrier discharge lamp with outer and inner electrodes has a tube that is arranged on the lamp stand end of the discharge vessel and that surrounds the lamp stand. The tube serves to receive a seal in order to install the lamp in a process chamber in a gastight manner. Power supply of the outer electrodes is separated from the power supply for the inner electrodes coming out of the lamp stand by means of the above-mentioned tube. This makes it possible to prevent effectively parasitic discharges between the power supplies which are applied at different potentials during operation also in process chambers under negative pressure.

19 Claims, 1 Drawing Sheet

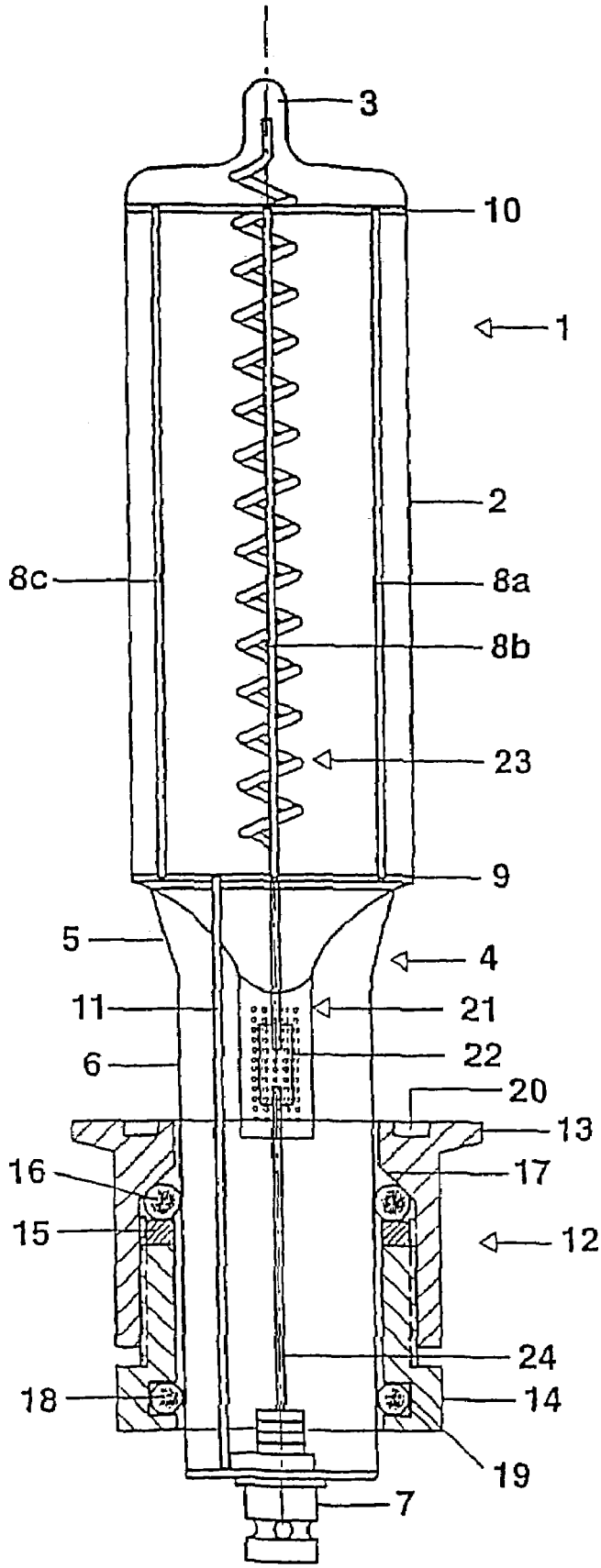
3
10
1
2
8c
8a
8b
23
9
5
4
11
21
22
6
20
13
16
17
15
12
24
18
14
19
7

DIELECTRIC BARRIER DISCHARGE LAMP WITH A BASE

TECHNICAL FIELD

The invention is based on a dielectric barrier discharge lamp.

The term "dielectric barrier discharge lamp" in this case encompasses sources of electromagnetic radiation based on dielectrically impeded gas discharges. The spectrum of radiation may in this case include both the visible range and the UV (ultraviolet)/VUV (vacuum ultraviolet) range as well as the IR (infrared) range. In addition, a fluorescent layer may also be provided for the purpose of converting VUV radiation into radiation having longer wavelengths, for example UVA or visible radiation (light).

A precondition for a dielectric barrier discharge lamp is, by definition, at least one so-called dielectrically impeded electrode. A dielectrically impeded electrode is separated from the interior of the discharge vessel or the discharge gas by means of a dielectric. This dielectric (the dielectric barrier) may be in the form of, for example, a dielectric layer covering the electrode, or it may be formed by the discharge vessel of the lamp itself, namely when the electrode is arranged on the outside of the wall of the discharge vessel. The latter case is referred to below for short as "outer electrode".

The present invention relates to a dielectric barrier discharge lamp which has at least one outer electrode of the abovementioned type which is essentially in the form of a strip. In addition, the lamp comprises an elongate or tubular discharge vessel which is closed at both ends and surrounds an ionizable filling.

The ionizable filling generally consists of a noble gas, for example xenon or a gas mixture. During the gas discharge, which is preferably operated using a pulsed operating method as described in U.S. Pat. No. 5,604,410, so-called excimers are formed. Excimers are excited molecules, for example $Xe_2$*, which emit electromagnetic radiation when they return to their original, generally unbound state. In the case of $Xe_2$*, the maximum molecular band radiation is approximately 172 nm.

As a result, such lamps are suitable as UV/VUV radiators in process technology, for example surface cleaning, photolytics, ozone generation, metallization and UV curing. For this purpose, it is generally necessary to operate the lamp directly in a low-pressure process gas atmosphere or vacuum. In this case, suitable precautions should be taken to install such radiators in a gas-tight manner in an appropriate process chamber.

PRIOR ART

The specification U.S. Pat. No. 6,060,828, in particular FIGS. 5*a* to 5*c*, has already disclosed such a lamp having an Edison screw base for general lighting. This lamp has a helical electrode within the discharge vessel. In addition, four electrodes in the form of strips are arranged on the outer wall of the discharge vessel.

EP-A 1 088 335 discloses a dielectric barrier discharge lamp, which is suitable for UV irradiation, having a base. Although the base has a flange which is connected to the pinched foot of the lamp by means of a potting compound and is suitable for low-pressure applications, this design is less suitable for high-vacuum applications. An additional disadvantage is the fact that a relatively large amount of potting compound is required if it is intended to fill all of the space between the pinched foot and the circular-cylindrical inner wall of the base shell. However, if gaps are left exposed, a low pressure prevails, in the case of low-pressure applications, in the region between the pinched foot end and the subsequent seal, too. There is then the risk of parasitic gas discharges between the power supply lines.

SUMMARY OF THE INVENTION

The object of the present invention is to provide an improved dielectric barrier discharge lamp. A further aspect is for it to be possible to use the dielectric barrier discharge lamp in a low-pressure environment.

This object is achieved by a dielectric barrier discharge lamp having a base, the discharge lamp having the following: an elongate discharge vessel, which is sealed at both ends, and whose wall surrounds an ionizable filling, electrodes, at least one of the electrodes being an inner electrode, i.e. being arranged within the discharge vessel, and at least one of the electrodes being an outer electrode, i.e. being arranged on the outside of the wall of the discharge vessel, a power supply line for the at least one inner electrode and a lamp foot, through which the at least one inner electrode is connected in a gas-tight manner to the power supply line, characterized in that the base comprises a tube which is fitted to the lamp foot-side end of the discharge vessel and surrounds the lamp foot.

Particularly advantageous refinements are described in the dependent claims.

The basic idea of the invention is to fit a tube, which surrounds the lamp foot, to the lamp foot-side end of the discharge vessel of the dielectric barrier discharge lamp. This makes it possible to separate, in a gas-tight manner, the two power supply lines for the outer and inner electrodes. This makes it possible to prevent the parasitic gas discharges mentioned initially between the power supply lines at a low pressure.

In order also to make possible different diameters for the discharge vessel and the tube fitted thereon, it may be expedient to provide a suitable transition region. In this case, the tube has a cylindrical and a conical section, the conical section connecting the discharge vessel to the cylindrical section.

For the purpose of installing the lamp according to the invention in a gas-tight manner in a process chamber, the tube expediently also has sealing means.

In one preferred embodiment, this sealing means is realized by a small flange seal which is plugged over the tube. Suitable for this purpose are, in principle, conventional small vacuum flange seals, which may have been modified in a suitable manner, for glass tubes. The power supply line for the outer electrodes has a conductor track-like structure, as do the outer electrodes themselves. The thickness of these structures is typically only a few micrometers. This makes it possible for the power supply line, which is arranged on the outside of the tube, of the outer electrodes to be passed through, in a gas-tight manner, the O ring which is generally used as the seal in the case of small vacuum flanges. In addition, a connection plug, for example of the type BNC-HT, is expediently provided on that end of the tube which faces away from the lamp, said connection plug being connected to the two power supply lines. Further details in this regard are given in the exemplary embodiment.

Alternatively, either a metallic vacuum flange may be connected to the free end of the tube by means of glass transition elements or a glass flange may be connected to the free end of the tube by being fused on directly.

In addition, the power supply line for the outer electrode need not necessarily be arranged in the manner of a conductor track on the outside of the tube. Since the outer electrodes are preferably connected to ground potential, it may also be advantageous for the outer electrodes to be connected directly, for example by means of a suitable contact spring, to the metallic process chamber.

If in any case, as is explained above, the lamp according to the invention is installed in a process chamber in a gas-tight manner with the aid of the sealing base, the attached tube separates the power supply line, which is surrounded by air pressure, of the inner electrode from that part of the power supply line, connected to the outer electrodes, which is subjected to the process gas atmosphere or vacuum. This effectively prevents the initially mentioned parasitic discharges between the power supply lines lying at different potentials during operation.

BRIEF DESCRIPTION OF THE DRAWING

The invention will be explained in more detail below with reference to an exemplary embodiment. The FIGURE shows:

a plan view of a dielectric barrier discharge lamp according to the invention having a base, including a base adapter (sectional illustration).

PREFERRED EMBODIMENT OF THE INVENTION

The FIGURE shows a schematic illustration of a dielectric barrier discharge lamp 1 according to the invention having a base. In this case it is a UV/VUV radiator, for example for surface cleaning, photolytics, ozone generation, metallization or UV curing. This radiator is designed for an electrical power consumption of approximately 20 W. The discharge lamp 1 has a circular-cylindrical discharge vessel 2 made of 0.7 mm to 1.5 mm thick quartz glass. The discharge vessel 2 has an outer diameter of approximately 40 mm and a length of approximately 120 mm. The interior of the discharge vessel 2 is filled with xenon at a pressure of 20 kPa.

The discharge vessel 2 is sealed at a first end in the form of a dome and has an exhaust tip 3 in the center of the dome. In the region of the lamp foot opposite the exhaust tip 3, a quartz tube 4 is fused to the discharge vessel 2. Alternatively, this quartz tube may also be attached by means of glass solder. The quartz tube 4 has a conical section 5 and a circular-cylindrical section 6. The conical section 5 connects the tubular discharge vessel 2 to the circular-cylindrical section 6, whose outer diameter is approximately 25 mm. Arranged on that end of the quartz tube 4 which faces away from the lamp is a connection plug 7 of the type BNC-HT.

Six outer electrodes 8*a*-8*f* (the outer electrodes 8*d*-8*f* cannot be seen in FIG. 1) in the form of 12 cm long, approximately 1 to 1.5 mm wide, thin platinum strips are fitted to the outside of the discharge vessel 2 equidistantly and parallel to the lamp longitudinal axis. The ends of the electrode strips 8*a*-8*f* are each connected to one another by means of a peripheral platinum strip 9, 10. One platinum strip 9, which is attached in the immediate vicinity of the connection between the discharge vessel 2 and the quartz tube 4, is connected to a further platinum strip 11. This further platinum strip 11 extends to the outside of the quartz tube 4 and ends at the connection plug 7, and it is connected to the first pole of said connection plug 7. In this manner, this platinum strip 11 acts as a power supply line for the outer electrodes 8*a*-8*f*.

Arranged on the circular-cylindrical section 6 of the quartz tube 4 is a modified base adapter 12 of the type ISO KF 40 (sectional illustration). It comprises a small vacuum flange 13 and an inner sleeve 14 which is screwed thereto. The inner sleeve 14 presses an O ring 16 against a bevel 17 of the small flange 13 by means of a metal ring 15. This O ring 16 thus acts as a seal against the outside of the quartz tube 4. A further O ring 18 is inserted in an inner groove 19 on the thread-free end of the inner sleeve 14. This results in a stress-free, gas-tight mounting of the lamp 1 in the base adapter 12. An annular groove 20 on the sealing side of the small flange 13 serves the purpose of accommodating a centering ring, known per se, having an O ring (not illustrated) for installation in a process chamber (not illustrated).

At the end opposite the exhaust tip 3, the discharge vessel 2 is tapered and forms a pinch seal 21. The pinch seal 21 ensures, with the aid of a molybdenum sealing film 22, a gas-tight connection between the inner electrode 23 and an outer power supply line 24. This power supply line 24 is connected to the second pole of the connection plug 7 (not shown).

The inner electrode 23 is a helical metal wire arranged centrically within the discharge vessel 2. That end of the coil electrode 23 which is opposite the pinch seal 21 is fixed in the exhaust tip 3. The respective diameters of the metal wire and the coil are 1 mm and 8 mm. The pitch, i.e. the path within which the coil performs a complete rotation, is 12 mm.

Details of the way in which the electrodes function during lamp operation are described in the above-cited U.S. Pat. No. 6,060,828, in particular in the description relating to FIGS. 5*a* to 5*c*.

The invention claimed is:

1. A dielectric barrier discharge lamp having a base, the discharge lamp having the following: an elongate discharge vessel, which is sealed at both ends, and whose wall surrounds an ionizable filling, electrodes, at least one of the electrodes being an inner electrode, being arranged within the discharge vessel, and at least one of the electrodes being an outer electrode, being arranged on the outside of the wall of the discharge vessel, a power supply line for the at least one inner electrode and a lamp foot, through which the at least one inner electrode is connected in a gas-tight manner to the power supply line, characterized in that the base comprises a tube which is fitted to the lamp foot-side end of the discharge vessel in a gas tight manner and surrounds the lamp foot and has a sealing means.

2. The dielectric barrier discharge lamp having a base as claimed in claim 1, the sealing means comprising a vacuum flange.

3. The dielectric barrier discharge lamp having a base as claimed in claim 2, the vacuum flange being plugged onto the tube.

4. The dielectric barrier discharge lamp having a base as claimed in claim 1, a power supply line for the at least one outer electrode being arranged on the outside of the tube and being passed through the sealing means.

5. The dielectric barrier discharge lamp having a base as claimed in claim 1 having a connection plug on that end of the tube which faces away from the lamp, at least the power supply line for the inner electrode being connected to said connection plug.

6. The dielectric barrier discharge lamp having a base as claimed in claim 5, the connection plug being of the type BNC-HT.

7. The dielectric barrier discharge lamp having a base as claimed in claim 1, the outer electrode(s) for the outer electrode(s) having conductor track-like structures.

8. The dielectric barrier discharge lamp having a base as claimed in claim 7, the conductor track-like structures comprising two or more strips which are fitted in the axial direction and with a mutual spacing on the outside of the discharge vessel.

9. The dielectric barrier discharge lamp having a base as claimed in claim 2, the vacuum flange being made of the same material as the tube and being fused to the free end of the tube.

10. The dielectric barrier discharge lamp having a base as claimed in claim 2, the vacuum flange being made of metal and being fused to the free end of the tube by means of glass transition elements.

11. The dielectric barrier discharge lamp having a base as claimed in claim 1, the inner electrode being helical and being oriented axially with respect to the discharge vessel.

12. The dielectric barrier discharge lamp having a base as claimed in claim 1, the tube having a cylindrical and a conical section, and the conical section connecting the discharge vessel to the cylindrical section.

13. The dielectric barrier discharge lamp having a base as claimed in claim 2, a power supply line for the at least one outer electrode being arranged on the outside of the tube and being passed through the sealing means.

14. The dielectric barrier discharge lamp having a base as claimed in claim 3, a power supply line for the at least one outer electrode being arranged on the outside of the tube and being passed through the sealing means.

15. The dielectric barrier discharge lamp having a base as claimed in claim 1 having a connection plug on that end of the tube which faces away from the lamp, at least the power supply line for the inner electrode being connected to said connection plug.

16. The dielectric barrier discharge lamp having a base as claimed in claim 2 having a connection plug on that end of the tube which faces away from the lamp, at least the power supply line for the inner electrode being connected to said connection plug.

17. The dielectric barrier discharge lamp having a base as claimed in claim 3 having a connection plug on that end of the tube which faces away from the lamp, at least the power supply line for the inner electrode being connected to said connection plug.

18. The dielectric barrier discharge lamp having a base as claimed in claim 4 having a connection plug on that end of the tube which faces away from the lamp, at least the power supply line for the inner electrode being connected to said connection plug.

19. The dielectric barrier discharge lamp having a base as claimed in claim 1, the outer electrode and the power supply line for the outer electrode having conductor track-like structures.

* * * * *